United States Patent [19]

Kaufman

[11] 4,011,077

[45] Mar. 8, 1977

[54] COPPER COATED, IRON-CARBON EUTECTIC ALLOY POWDERS

[75] Inventor: Sydney M. Kaufman, Livonia, Mich.

[73] Assignee: Ford Motor Company, Dearborn, Mich.

[22] Filed: June 6, 1975

[21] Appl. No.: 584,562

[52] U.S. Cl. ..... 75/212; 29/182; 75/200; 75/213

[51] Int. Cl.[2] ..... B22F 3/16; C22C 1/04

[58] Field of Search ..... 75/212, 200, 213; 29/182

[56] References Cited

UNITED STATES PATENTS

| | | | |
|---|---|---|---|
| 2,273,589 | 2/1942 | Olt | 75/212 X |
| 3,223,523 | 12/1965 | Adler | 75/212 |
| 3,379,521 | 4/1968 | Butcher | 75/212 X |
| 3,778,100 | 11/1973 | Kizer | 75/212 |
| 3,838,982 | 10/1974 | Sanderow | 29/182.5 |

FOREIGN PATENTS OR APPLICATIONS

| | | | |
|---|---|---|---|
| 45-417 | 1/1970 | Japan | 75/212 |
| 1,123,685 | 8/1968 | United Kingdom | 75/212 |
| 779,969 | 4/1955 | United Kingdom | 75/212 |

OTHER PUBLICATIONS

Isaksson, S. E., Chem. Abs. No. 80: 40264x, 1973.
Ito, Teiji, et al., Chem. Abs. No. 79: 117566m, 1973.
Fischmeister, et al., "Fast Diffusion Alloying for Powder Forging Using a Liquid Phase, " In Powd. Met. 17(33): 227–240, 1974.
Lindskoy, P., et al., "Alloying Practice in the Production of Sintered Steels", The Institute of Metals, pp. 375–396, 1971.

*Primary Examiner*—Richard E. Schafer
*Attorney, Agent, or Firm*—Joseph W. Malleck; Keith L. Zerschling

[57] ABSTRACT

A mechanical mixture of selected powders is subjected to compressive forces to define a pre-compact, the pre-compact then being subjected to liquid phase sintering for producing a raw alloy steel product which is more economical and has enhanced physical properties, particularly tensile strength as compared to sintered compacts produced by the prior art to date. The improvement in physical properties and processing technique results principally from the use of a mechanical mixture consisting of a base iron powder and a coated alloyed additive powder having selected alloying ingredients (such as manganese, nickel, molybdenum, in an iron-carbon system); the particles of the alloyed powder have a thin flash coating of a low melting metal, such as copper, to control carbon diffusion into the base iron powder during liquid phase sintering.

16 Claims, 10 Drawing Figures

Fe - 2.0% Mn - 1.0% C
Made With Mechanically
Coated Alloy 13046 Admixed
In Iron Powder. 100X Fe - 0.5% Mn
0.5% C
This Sample Had .25%
Graphite Admixed. Uncoated Fe - 0.5% Mn
0.5% C
100X Fe - 1.0% Mn - 0.5% C
Made With Mechanically Coated
Alloy 13046 100X Fe - 1.0% Cu - 1.0% Mn - 0.5% C
Made From Copper And Iron
Powders Admixed With Uncoated
Alloy 13046 100X Alloy Powder 73045 100X Alloy Powder 73044 100X Alloy Powder 23046 100X

COPPER COATED, IRON-CARBON EUTECTIC ALLOY POWDERS

BACKGROUND OF THE INVENTION

Prealloyed ferrous powders suitable for molding without other powders by conventional powder metallurgy techniques have proceeded from the earlier usage of large amounts of alloying elements to small but balanced amounts of alloying ingredients to obtain equivalent and useful physical properties in comparison to wrought alloy steels. Major achievements in economy cannot be achieved because the balanced alloy ingredients are still too excessive in amount and the entire powder making cycle must be used for each distinct chemical composition. Thus, pre-alloyed powders are expensive compared to simple iron powders conventionally produced and it is unlikely that part producers will accept the limited number of pre-alloyed compositions commercially available.

Mechanical mixtures of simple iron powders with small amounts of pre-alloyed powders has been deemed a promising mode of providing alloying during sintering of the compacted powders, but exactly how to achieve adequate and economical homogenization of the ingredients of the alloy powder into the base iron powder is not known to the art. The prior art recognizes that, conceptually, admixtures seem to offer substantial economic advantages over pre-alloyed powders.

One method of admixing and joining master alloy and base iron powders is to use solid state particle diffusion; this is unsatisfactory because it is limited by the number of inner particle contacts. Another method of carrying out master alloy and base powder admixing and joining is to use gasification of one of the components to achieve diffusion; this is limited because of the absence of sufficient acceptable candidates or components for this method. However, if the master alloy powder is converted to a liquid phase there can occur an increase in particle contact. To arrive at this goal and to do so economically, there must be an improvement in the kinetics of the sintering process, particularly a reduction in the necessary liquidus temperature for the entire alloying powder during sintering.

This invention finds particular use for copper, and equivalent carbon diffusion barriers, to dramatically improve sintering kinetics. Copper has been used in powder metallurgy, not only as an alloying ingredient, but as an infiltrant to the compacted powders for preventing errosion of the surface. Heavy quantities of copper powder have been typically mixed with a ferruginous powder to provide infiltration. The mass, resulting from this processing, shrinks and warps considerably through coalescence thereby reducing surface contact between the infiltrant and the ferruginous mass. But this art, by itself, even though incorporating copper, does not teach how one can reduce the liquidus temperature of the master alloy powder to a eutectic temperature when combined with a low carbon base powder.

Some thought, unrelated to sintering kinetics, has been given by the prior art to coating a base iron powder with copper or other low melting equivalents. It was hoped that this would create a strong welded network between the base iron powder particles. Instead, this has resulted in a significant reduction of the physical properties of the resulting sintered product.

SUMMARY OF THE INVENTION

A principal object of this invention is to provide a unique master alloy powder material which, when combined with a relatively low carbon base iron powder, will provide unprecedented economy and improvement in physical properties of a resulting compact subjected to liquid phase sintering.

Yet still another object of this invention is to provide a raw alloy steel product produced by a method which utilizes lower temperatures and shorter sintering times than that contemplated by the prior art and yet will provide a resulting alloy steel product which is characterized by high strength, particularly in tension, good hardenability (either air hardening or quench and draw) and good density in the range of 6.6–6.8 g./cc.

Another principal object of this invention is to provide a unique method of fabricating iron powder parts, the method being particularly characterized by subjecting a pre-alloyed master iron powder material to a thin coating treatment whereby each particle is coated with a low melting alloying agent such as copper; the coated master alloy powder material is then mechanically blended with a base iron powder, relatively low in carbon, at approximately a 9:1 ratio to provide a predetermined steel alloy after being subjected to a relatively low temperature and short-time sintering operation.

Yet still another object of this invention is to provide a unique method of successfully sintering an additive powder to a base powder at about the eutectic temperature of the additive powder. Even more broadly, it is an object of this invention to provide a method for preventing carbon diffusion in powder metallurgy techniques where premature diffusion will affect the economics or quality of the technique.

The coated alloy or intermediate powder is unique by virtue of substantially each particle thereof being enclosed in an extremely thin envelope of copper which is unalloyed and constitutes less than 0.5 weight percent of the alloy powder. This invention teaches how to obtain a sintered iron-carbon-alloy product which is unique by virtue of:

a. high as-sintered strengths for equivalent green compacts, particularly in tension,
b. a copper alloy content of less than 0.05%, with balanced amounts of manganese or nickel up to 10% and significant amounts of molybdenum up to 10%,
c. an as-sintered air-hardenable grade better in hardness than any as-sintered iron-carbon alloy material, and
d. has a density substantially greater than equivalent uncoated sintered products.

Particular features pursuant to the method aspects of this invention include the use of an anti-diffusion agent for carbon, such agent preferably comprising copper or other equivalent low-melting alloy that can be formed as a flash coating on substantially each particle of a high carbon master alloy metal powder mix; the coated master alloy powder is blended with a low carbon base metal powder in approximately a 9:1 ratio and is subjected to mechanical compression with somewhat lower stress to define a compact; the compact is subjected to a sintering operation utilizing a temperature substantially at the eutectic temperature for the alloy powder, sintering is carried out for a period to allow for unitary melting of the alloy powder, subsequent carbon migration and solidification of the alloy phase.

IN THE DRAWINGS

DETAILED DESCRIPTION a. Introduction

There has been a desire on the part of the prior art to use low melting eutectic iron-carbon alloy powders to introduce common alloying elements into another iron powder, but this technique has never really been reduced to practice successfully. The goal and concept is relatively simple: an element which is to be added to iron is dissolved, in controlled amounts, in a liquid iron-carbon alloy with approximately 4.5% dissolved carbon. The resultant ternary alloy is then reduced to a solid powder by a convenient means such as atomization, which method should prevent loss of carbon. The atomized powder is then mechanically mixed in a predetermined ratio with pure iron powder (formed by atomization or even cryogenic methods) to give the desired overall concentration of the third element of the master alloy powder in the admixture of both the iron powder and the master alloy powder. The admixture is then cold compacted, under ambient temperature conditions, and the compact subjected to typical sintering at a temperature sufficiently high to melt the particles of the Fe-C- alloy powder. When melting occurs, the liquid is expected to wet and coat the still solid pure-iron particles, and then re-solidify when sufficient carbon has been transferred (diffused) to bring the carbon level in the liquid to about 2.0% by weight.

Figure 1:
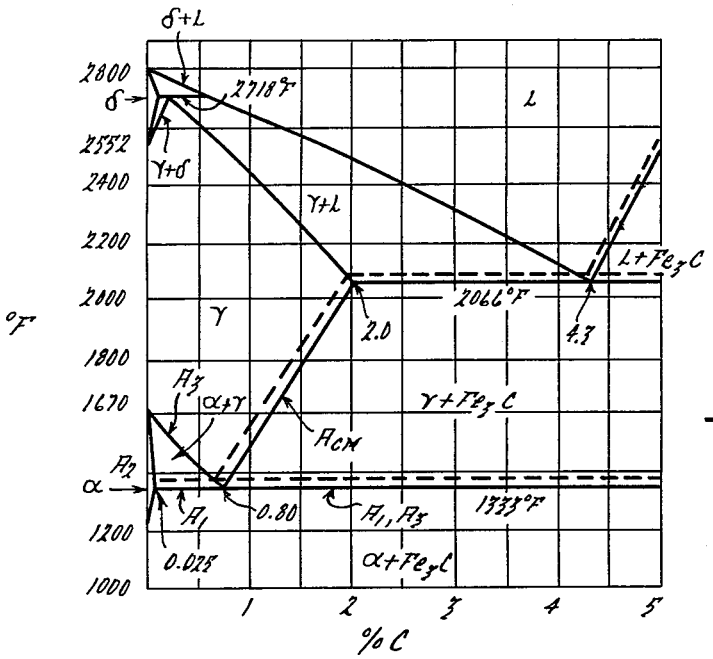
FIG. 1 is a schematic flow diagram of a preferred sequence for the method of this invention.
Figure 2:
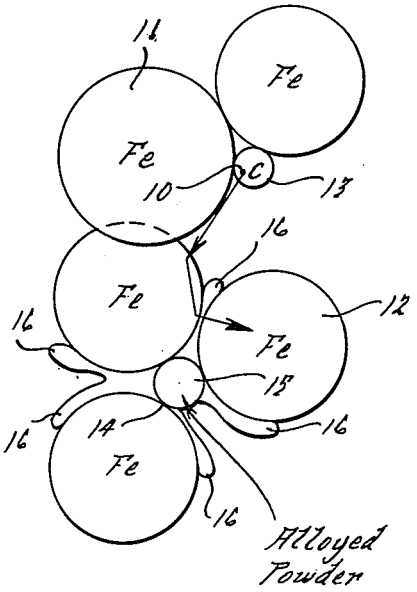
FIG. 2 is a diagram of some enlarged particles of a green compact illustrating the sintering kinetics provided by this invention.
Figure 3:
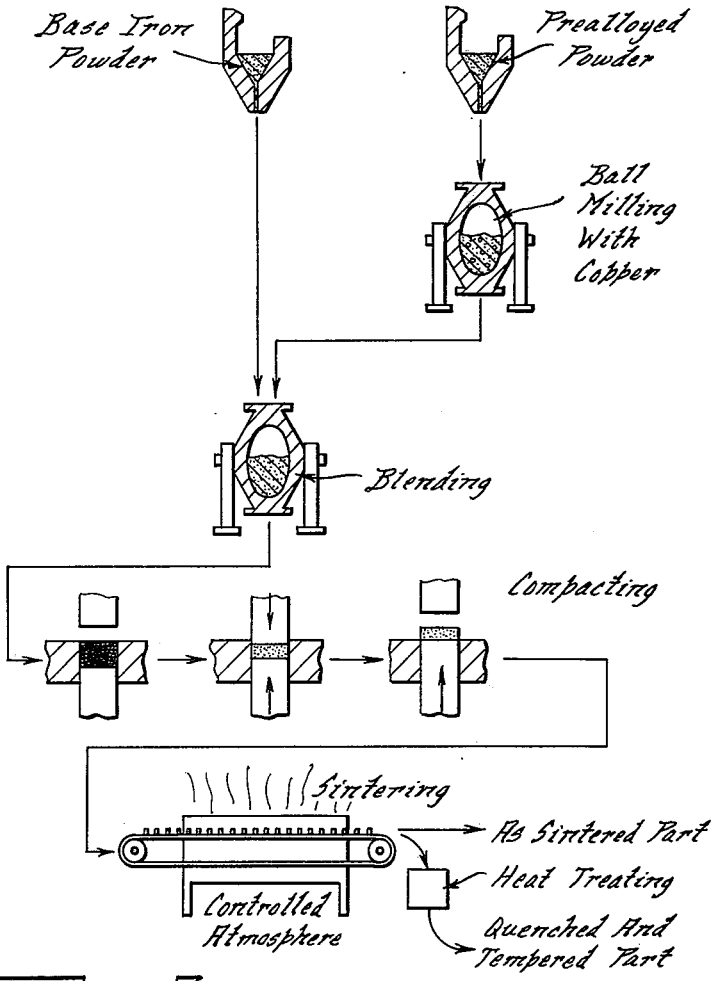
FIG. 3 is a phase diagram for an iron-carbon system.
Figure 1:
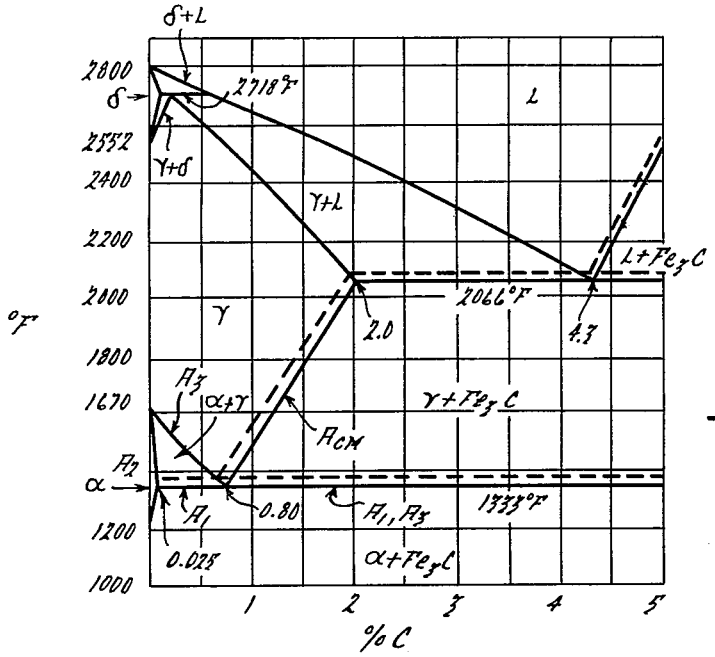
Figure 2:
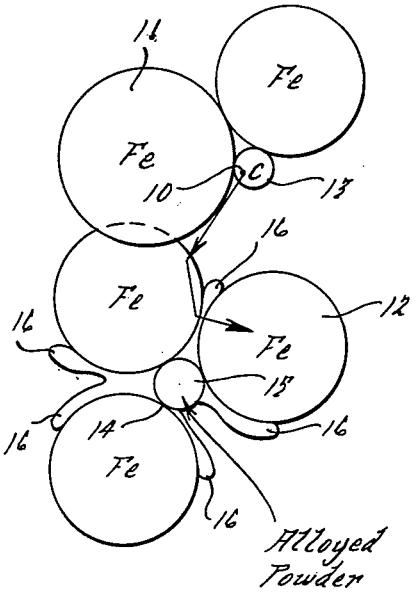
Figure 3:
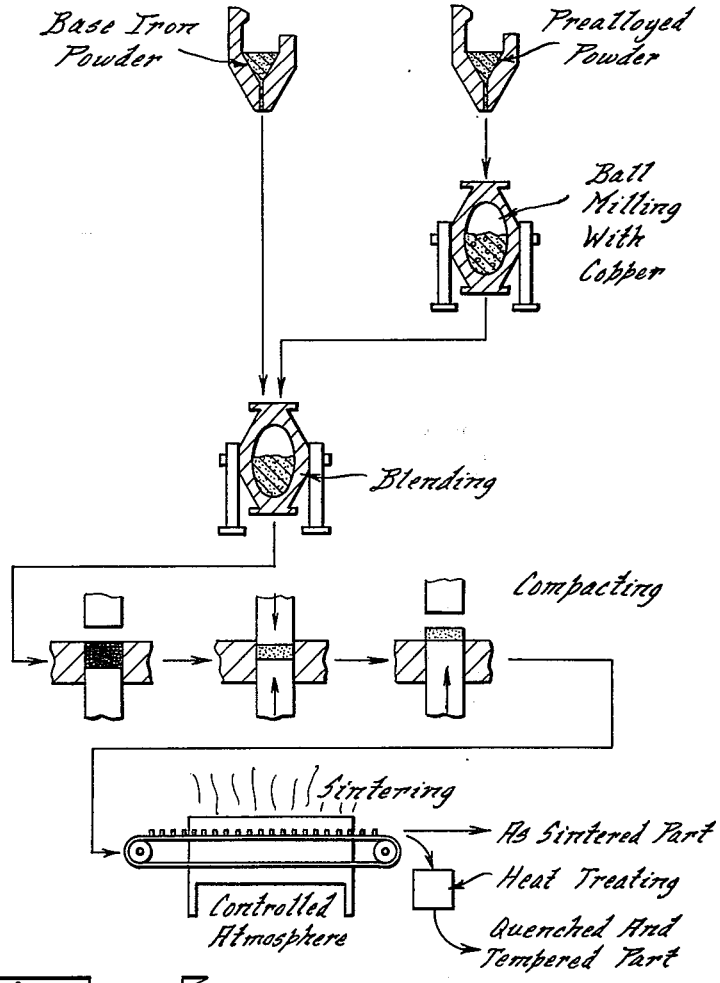

Under the state of the art as well known, such expectations are not realized, and certainly not realized at an economical sintering temperature. To illustrate this further, reference is made to FIG. 1 where a conventional iron carbon phase diagram is illustrated. Upon heating to the temperature level of about 2060° F–2070° F, a master alloy powder containing 4.3% carbon should effectively melt. However, carbon has a tremendous finity to diffuse rapidly prior to the attainment of such melting or liquidus temperature. The rate of carbon loss from this type of master alloy powder to the base iron powder is so rapid, even in a vacuum, that maintaining the eutectic carbon concentration in the master alloy is practically impossible in all but the most rapid and uneconomical heating cycles. So what really takes place is that the carbon (such as an atom 10 in FIG. 2) migrates out of the master alloy powder during a lower temperature level (below 2066° F; such diffusivity is not limited by particle contact distances and diffusion will readily proceed to adjacent particles 11 or remote particles 12. Thus the liquidus temperature for the remaining or residual alloy powder particle 13 is increased (since the % carbon is other than eutectic) and this results in only partial melting of the particle 13 at the eventual sintering temperature (usually no higher than 2200° F). No matter how long the sintering temperature is maintained, there is some portion of solid that is isolated and the diffusion kinetics which control homogenization become too sluggish to allow appreciable transfer of the alloying elements into the base iron powder. The more carbon lost, the less alloy diffusion that takes place and the greater the inhomogeneity after sintering.

The invention herein effectively prevents such premature solid state diffusion of carbon between and into the base iron particles. Certain metallic elements, particularly copper, is an effective barrier to carbon loss during heating to the sintering temperature and while in the solid state condition. This barrier arises because carbon cannot diffuse through copper in order to reach the purer iron even with the alloy powder in intimate contact with the iron powder. Carbon is known to diffuse exceedingly slow through copper. Thus, during the time normally involved in heating iron-alloy powder compacts to sintering temperatures (approximately 10–20 minutes) uncoated master alloy powders will de-carburize rapidly while coated powders will show no perceptible decarburization.

This carbon diffusion barrier is applied as an envelope 14 (see FIG. 2) to each particle of the master alloy of powder in a controlled ultra thin amount. The supporting eutectic alloy powder particle 15 can be of a variety of ingredients but most importantly the copper (carbon barrier) envelope must be in the unalloyed condition surrounding each particle of the powder.

Although it is not totally understood what exactly takes place during the sintering with the coated powder, it is believed that until the liquidus or the melting point of the copper envelope 14 is reached (at about 1980° F) which is substantially close to the liquidus or melting temperature of the eutectic carbon alloy iron powder particle 15, the copper performs as an effective barrier to retain the carbon in the alloy powder at about 4.3–4.5%. Even after the melting of the copper the miniscus or surface tension of said melted copper will sustain an envelope about said alloy powder particles for a short period of time, probably until such time as the alloying ingredients have begun to melt. It is at this point that the alloying ingredients, along with the copper, will tend to spread out and migrate across the surface areas of adjacent baseiron particles at zone 16, readily permitting solution of the alloying ingredients and copper thereinto.

Other carbon barrier agents can be employed in addition to copper, such as silver and platinum. Two primary characteristics must be exhibited by such barrier: (a) it must prevent diffusion of carbon therethrough, and (b) it must be completely soluble in the master alloy when the latter is in the molten state. Lead will vaporize prematurely thereby resulting in a lack of carbon control. Similarly, tin will prematurely melt in advance of achieving the liquidus temperature for the master alloy. Lead and tin have difficulty in dissolving in molten iron and will absolutely not dissolve in solid iron.

b. Comprehensive Method

Specific features of a comprehensive method of this invention, including preferred conditions, is as follows:

1. A hypereutetic iron-carbon-alloy powder is prepared. Such powder may be formed by conventional atomization techniques utilizing a melt having a chemistry in which the alloy ingredients are contained. For the purpose of economy, it is preferred that the alloying ingredients be introduced to said melt in low but balanced amounts such as ½% each of manganese, molybdenum, chromium, nickel, with the total alloying content being no greater than 2.5% for purposes of economy. However, it is to be expected that with greater alloying ingredients, greater resulting strength can be achieved. Accordingly, such pre-alloyed powder can operably contain between 0.5–20% of alloying ingredients.

The atomization process should be carried out to define a particle size for said powder of about −200 mesh but can be operably used within the range of −100 +325. The pre-alloyed powders should contain a significant amount of dissolved carbon and should exceed the carbon content of the base iron powder; the base iron powder must contain 2.0% or less carbon. Preferably the carbon content should be in the range of 4.3–4.5%, but can be within the range of any hypereutectic carbon content for general operability.

2. The pre-alloyed powder is coated. To this end, a thin envelope of a metal, which is characterized by a low carbon diffusion therethrough, is imparted to substantially each particle. The envelope should constitute from 0.25–1.5% by weight of said pre-alloyed powder and it is critical that such envelope be extremely thin having a thickness as little as 15 angstroms, but typically about 200 microns.

Preferably, the carbon diffusion barrier is copper since it meets criteria for such metal selection namely: (a) it has an extremely low rate of carbon diffusion therethrough, (b) it is completely soluble in the pre-alloyed powder when in the liquid condition, (c) does not vaporize or melt off prematurely before the pre-alloyed powder achieves a liquidus condition and (d) is readily available and economical to employ. Other metals which would meet the first two criteria hereof comprise platinum, silver and gold. Although lead and tin would be effective in preventing carbon diffusion, they suffer from the ability to maintain a solid state condition and remain as a thin envelope substantially up to the point where the pre-alloyed powder becomes liquid. These latter materials either vaporize prematurely or melt off prematurely.

Preferably the copper thin envelope can be imparted to the pre-alloyed powder by ball milling utilizing 0.5 inch diameter copper balls, with the pre-alloyed powder in a slurry condition by use of benzene. The ball milling should be carried out for at least 20 hours, typically about 48 hours for powder of about 10 in.$^3$ in a 3 × 6 cylindrical volume mill with ½ copper balls. The milling time depends on the mill volume, mill diameter, size of copper balls, and the speed of rotation. It is conceivable that milling time can be as low as 2 hours with optimization of these factors. The longer ball milling is carried out, the greater the thickness and the greater the statistical probability of forming a complete envelope about each particle. However, it has been discovered that ball milling for at least 20 hours forms complete envelopes. Other substantially equivalent methods for imparting such copper thin envelope may comprise: (a) chemical treatment whereby the prealloyed powder particles are placed in a slightly acidic solution containing copper sulphate, the solution may preferably be formed by the use of sulfuric acid, and (b) an electrolytic deposition technique, the chemical treatment particularly uses the following parameters:

| | |
|---|---|
| $CuSO_4 . 5H_2O$— | 10 g/l |
| NaOH | 10 g/l |
| formaldehyde | 37% 10 ml/l |
| Rockelle salt | 50 g/l |
| pH | 12.5 |
| plating rate | μin./min. at 75° F = 2.0 |

3. Next, a base iron powder is provided; it may be formed by a conventional atomization technique where a base iron melt with a carbon content substantially below 4.3% is utilized, and preferably is about 0.10–8% carbon. Such base iron powder is devoid of any alloying ingredients and may have 0.2% $O_2$ on surface. This should not preclude adding some alloying ingredient to base powder, and will be accounted for in the adjustment of the alloying powder. The powder should be sized to about −100 +325 which facilitates promoting an intimate contact between each particle of pre-alloyed powder with a particle of the base-iron powder. Strength characteristics, according to this invention, will be increased if the surface of each iron based powder particle is (a) relatively free of oxides and (b) the oxygen content of said base powder must be below 0.5% but typically no greater than 0.2%. But more importantly, the base-iron powder should have a relatively low carbon content, preferably below 2% in order to operate effectively with carbon control of the pre-alloyed powder.

4. The base-iron powder and pre-alloyed powder are intimately mixed to form an admixture. For purposes of maximum economy of this method, the ratio of the base iron powder to the pre-alloyed powder should be in the range of 9/1–100/1. However, for purposes of providing a noticeable increase in the compressibility of the admixture, which is related to the ability to obtain high transverse rupture strength, the blend ratio should be no greater than 5/1, thereby permitting the copper coating of the alloy powder to facilitate compressibility. Although it is not necessary, the admixture may be further milled for about 24 hours. Blending should take place in a mechanical blender to promote the subsequent step of compaction by addition of a lubricant in the form of zinc stearate (in an amount of 0.75% of the weight of the admixture). Additional graphite may also be added to the admixture, but utilization of the present anti-carbon diffusion mechanism, necessity for additional graphite is obviated.

5. The admixture is compacted to a shape having a predetermined density, typically about 6.7 g./cc. Required forces to achieve such typical density will be on the order of 30–35 tsi. The strength characteristics of the resulting sintered compact will vary somewhat with respect to green density; for example, for a green density of about 6.2 g./cc., the transverse rupture strength will be about 66,000 psi and for a green density of about 6.8, the transverse rupture strength will be about 125,000 psi (forces to achieve a green density of 6.2 g./cc. will be on the order of 20 tsi and to achieve a green density of 6.8, a compacting pressure of around 35 tsi will be required).

An improvement in compressibility results from the presence of the copper coating; this may be explained as slight smearing of the copper coating which absorbs energy.

6. The compact is then heated in a sintering furnace under a controlled atmosphere to about the eutectic temperature for the pre-alloyed powder; such temperature is held for a period of about 20 minutes to allow diffusion of both the alloying ingredients as well as carbon into the base iron powder after the liquidus temperature is achieved. The sintering temperature preferred, with the coated pre-alloyed iron-carbonalloy, is in the range of 2060°–2080° F. Preferably such sintering temperature will be slightly in excess of 2066° F, although it is recognized that a sintering range of between 2050° F and 2100° F is an operable sintering temperature range for iron carbon systems of this invention. When employing the present invention in metal systems other than iron-carbon, the sintering temperature should be substantially at about the eutectic temperature for the powder containing the excess carbon and which is to be diffused into the other powder.

The protective atmosphere may be a hydrogen gas having a dew point of around −40° F or it may be any other rich endothermic atmosphere with 0.3% $CO_2$.

The period of time at which the heated compact is held at the sintering temperatures is at least 30 minutes so that carbon diffusion and migration of the liquid alloys may diffuse into the base iron powder. During this period of time, the outer peripheral region of each base iron powder particle will become enriched in carbon and alloying ingredients; a metallurgical bond will be formed with the pre-alloyed powder particle in contact therewith.

During the heat up portion step, the high carbon content of the pre-alloyed powder particles is prevented from diffusing into the low carbon base iron powder until such time as the sintering temperature is reached; at the latter point copper becomes liquid slightly in advance of the alloyed particles becoming liquid so that both may move under miniscus forces about the generally spherical configuration of the base iron powder and from thence diffuse into the inner regions of the base iron particle. Diffusion takes place during substantially the thirty minute holding period; holding periods considerably in excess thereof do not achieve substantial gains in diffusion.

7. The sintered compact may be subjected to postsintering treatments, preferably in the form of air hardenable condition which allows the compact to achieve a hardness of $R_c$ 20–30 (untempered). The cooled sintering compact may be given a quench and temper treatment to enhance its physical characteristics, such as transverse rupture strength and strength in tension. Furthermore, the sintered compact may be subjected to reheating and forging while in the hot condition, followed by quench and temper. Any one of the combinations of these postsintering treatments will result in enhancement of the product properties.

c. Early Trials

Three different pre-alloyed powders were prepared with the following chemistry:

| Alloy | Carbon | Manganese | Nickel | Molybdenum |
|---|---|---|---|---|
| No.1 | 4.74 | — | 10.1 | — |
| No.2 | 5.05 | — | — | 9.70 |
| No.3 | 5.04 | 10.00 | — | — |

Each of the above pre-alloyed powders were sintered at a temperature between 2050°–2100° F. Each of the pre-alloyed powders were subjected to copper coating of the particles by being mechanically milled with copper balls each approximately .5 inch in diameter; the pre-alloyed powder was suspended in a slurry utilizing benzene. Ball milling was continued for a period of 96 hours. Each of the pre-alloyed powders were mixed with a water-atomized base-iron powder in a ratio of 9/1 (to form examples 1–3 respectively) and a small amount of zinc stearate lubricant was added in the proportion of about 0.75%. Examples 4–6 were prepared by mixing water atomized powder therewith in a ratio of 4.5/1 (example 6 utilizing 1 part Mn, 1 part Mo and 2 parts Ni in the pre-alloy powder). Example 7 consisted of only base iron powder plus graphite; examples 8 and 9 were the same as 7 except that two different levels of copper were added.

The admixture was compacted to a density of 6.5 g./cc. There were no additions of graphite made and the admixtures were compacted to form test bars. Each of the test bars were heated to a sintering temperature between 2075°–2130° F and each were held at the sintering temperature for approximately 30 minutes; the sintering atmosphere was hydrogen gas (−40° F dew point). Each of the test examples were then tested and rendered the following properities:

| | %Carbon | %Mn | %Mo | %Ni | %Cu | Density | Transverse Rupture Strength (psi) | | Hardness ($R_B$) | |
|---|---|---|---|---|---|---|---|---|---|---|
| | | | | | | | As-Sintered | Heat Treated | As-Sintered | Heat Treated |
| Example 1 | 0.4 | 1.0 | — | — | | 6.6 | 72,000 | 150,000 | 43 | 95 |
| Example 2 | 0.4 | — | 1.0 | — | | 6.6 | 73,000 | 120,000 | 44 | 85 |
| Example 3 | 0.4 | — | — | 1.0 | | 6.6 | 72,000 | 112,000 | 40 | 86 |
| Example 4 | 0.8 | 2.0 | — | — | | 6.6 | 120,000 | 100,000 * | — | — |
| Example 5 | 0.8 | — | — | 2.0 | | 6.6 | 110,000 | 142,000 | — | — |
| Example 6 | 0.8 | 0.5 | 0.5 | 1.0 | | 6.6 | 130,000 | 110,000 | — | — |
| Example 7 | 0.4 | — | — | — | | | 60,000–75,000 | X | 45–55 | X |
| Example 8 | 0.6 | — | — | — | 1.5 | — | 85,000–95,000 | X | 65–75 | X |

-continued

| | %Carbon | %Mn | %Mo | %Ni | %Cu | Density | Transverse Rupture Strength (psi) As-Sintered | Transverse Rupture Strength (psi) Heat Treated | Hardness ($R_B$) As-Sintered | Hardness ($R_B$) Heat Treated |
|---|---|---|---|---|---|---|---|---|---|---|
| Example 9 | 0.6 | — | — | — | 3 | | 85,000–115,000 | X | 65–75 | X |

* overtempered; actual strength is actually much better than data
X examples were not heat treated
- no measurements made A comparison of the as-sintered transverse rupture strength of the sintered product utilizing the smallest amounts of alloying ingredients, 1% or less, indicated that copper coating does not result in a dramatic increase in the strength over an equivalent as-sintered product utilizing a powder mixture where no copper coating is employed. This can be seen by comparing examples 1 through 3 with example 8, example 8 being representative of the prior art were there is no copper coating utilized. However, when the sintered product is subjected to a heat treatment in the form of heating to a temperature of 1550° F, water or oil quenching and tempering at 400° F for 0.5–1 hr., depending composition, the transverse rupture strength and hardness will exhibit superior levels.

Moreover, when alloying ingredients are increased above small amounts as a total, in excess of two or more percent by weight of the resulting product, the as-sintered rupture strength is increased significantly. This can be observed by comparing the heat treated transverse rupture strength for examples 1 through 3 with example 9 which contained 3% copper as opposed to 2% for examples 4–6. Even examples 4–6 obtained transverse rupture strengths in excess of the maximum achieved by example 9.

With respect to impact strength, the practice of this invention will result in improvement.

With respect to strength in tension, the practice of this invention will result in improvement.

The comprehensive method above described, includes novel sub-methods such as (a) a method for preventing solid state carbon diffusion in powder metallurgy wherein first and second powder collections may be prepared containing dissolved carbon in significant quantities with one of the collections having a carbon content exceeding the carbon content of the second powder collection by at least 0.5 %. One of the powder collections is provided with a thin envelope about each of the particles, the envelope being comprised of a metal having a melting point lower than, but substantially close to the melting point of the one powder collection. The metal is characterized by having a low diffusivity of carbon therethrough and is completely soluble in one of the powdered collections when the latter is in the molten state. The envelope metal constitutes from 0.10–1.5% by weight of the one powder collection. The powdered collections are intimately and homogeneously mixed and sintered at appropriate sintering temperatures whereby carbon diffusion takes place only after the thin envelopes has turned to a liquid condition.

Another sub-method comprises providing for preconditioning of a master alloy intermediate powder so as to be more useful in being blended with a base metal powder for making liquid phase sintered shapes. This sub-method particularly comprises (a) selecting an iron carbon-pre-alloyed powder containing at least one alloying ingredient selected from the group consisting of manganese, chromium, molybdenum, nickel, copper and vanadium, said alloying ingredients each being present in the range of 5–20% (although as much as 65%, has worked) and the total of said alloy ingredients being present in the range of 5–20%, (b) sizing said iron-carbon-alloy powder to a mesh size of −100, and (c) substantially enveloping each particle of said iron-carbon-alloying powder with a metal effective to act as a barrier to carbon diffusion in the solid state condition.

d. Product

Figure 9:
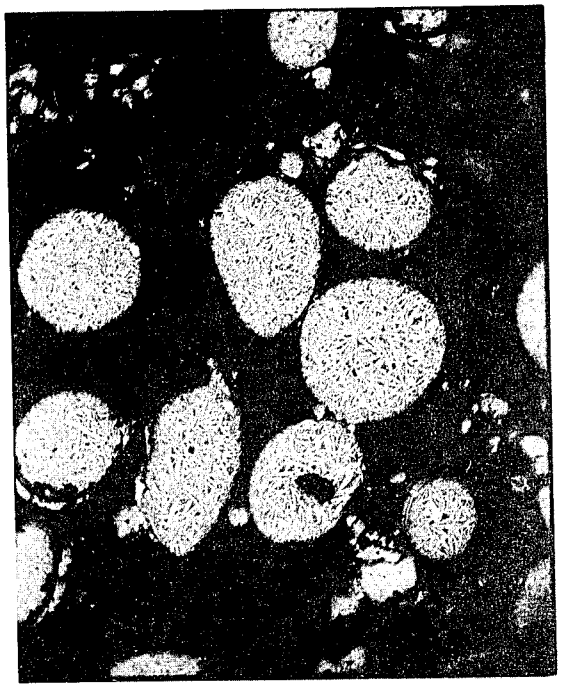
FIGS. 8–10 illustrate photomicrographs of the new intermediate powder of this invention, each view showing different experimental trials as described herein.
Figure 8:
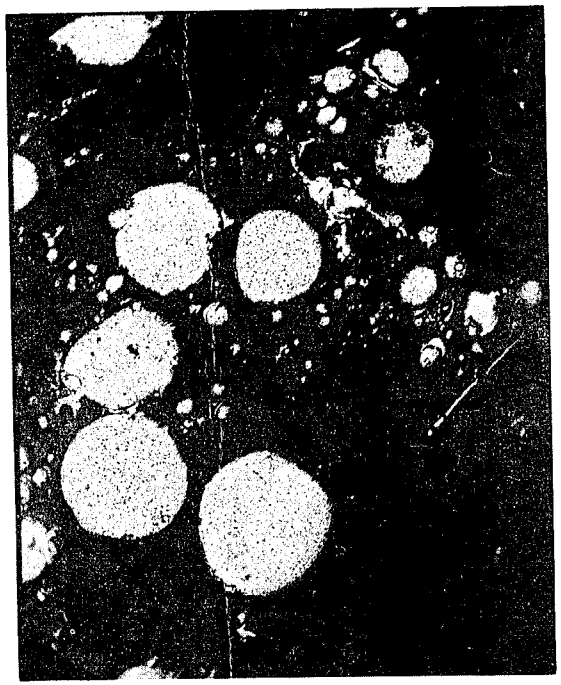
Figure 10:
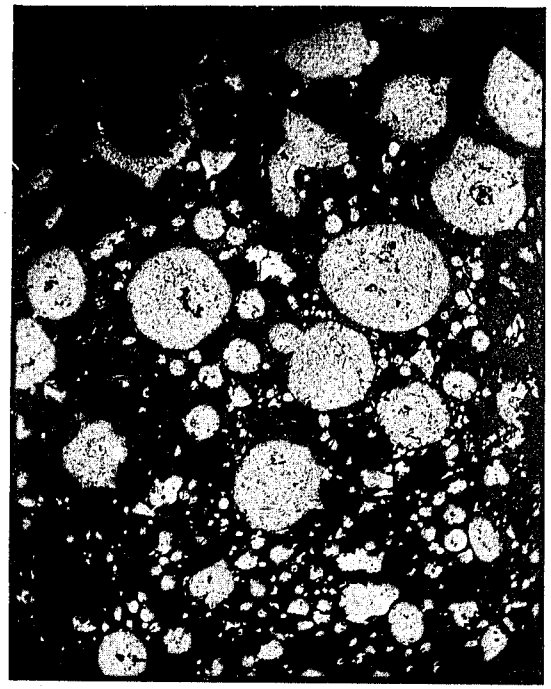

This invention comprehends teaching of a new prealloyed intermediate powder supply which is useful in being blended with the base iron powder for making sintered alloy parts by liquid phase sintering. The prealloyed powder composition or product is best shown in FIGS. 8–10, each being processed according to the procedure outlined in connection with the examples 1–3. The powder supply of FIG. 8 contains 10.1% nickel, therein, the pre-alloyed powder of FIG. 9 contains 9.7% of molybdenum, the pre-alloyed powder of FIG. 10 contains 10.0% manganese.

The powder supplies are each characterized by (a) atomized particles having a generally spherical configuration and each having a chemical analysis comprising at least 10% by weight of one or more elements selected from the group consisting of molybdenum, manganese, nickel, chromium and copper, (b) each particle having a thin flash coating of copper covering predominantly the outer surface of each particle, the thickness of said copper flash coating be no greater than 1 mil and constituting no more than 1.5% by weight of the powder material.

Each powdered particle is a hypereutectic composition of iron and carbon along with the alloying ingredient, such hypereutectic composition exhibiting iron carbide, free graphite and ferrite.

Figure 5:
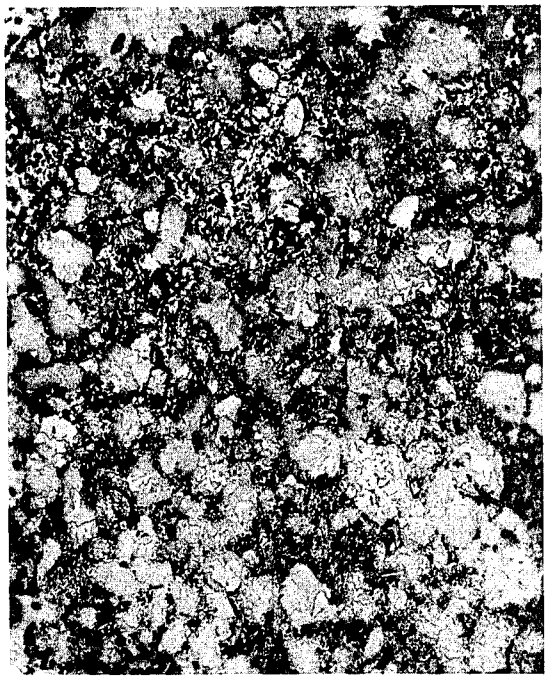
FIG. 5 is a photomicrograph (100x) like FIG. 4, but illustrating a sintered product which incorporated a coated alloy powder according to this invention; the composition contains Fe, 2.0% Mn and 1.0% C.
Figure 7:
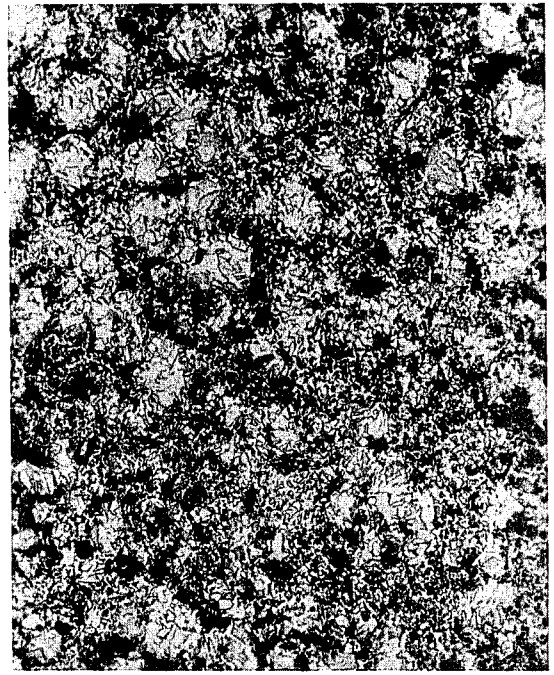
FIG. 7 is a view like FIG. 5 (100x) illustrating a sintered product made with coated powder according to this invention and containing Fe, 1.0% Mn, 0.5% C.

A new as-sintered or product composition is also presented by this invention and is best illustrated in FIGS. 5 and 7. The composition contains a matrix of iron-carbon particles sintered together in intimate contact, each ironcarbon particle has an interior peripheral zone containing dissolved and diffused alloying ingredients, each of the ironcarbon particles also have an outer exterior film rich in copper and alloying ingredients, said composition being further characterized by residual powdered particles containing iron-carbon-alloy disposed between and uniformly distributed throughout said iron-carbon matrix. The composition contains about 0.05% copper distributed within and about said matrix. The composition particularly exhibits a tansverse rupture strength of at least 70,000 psi, a hardness of $R_B$ 40 and the strength and tension of about 35,000 psi.

Figure 4:
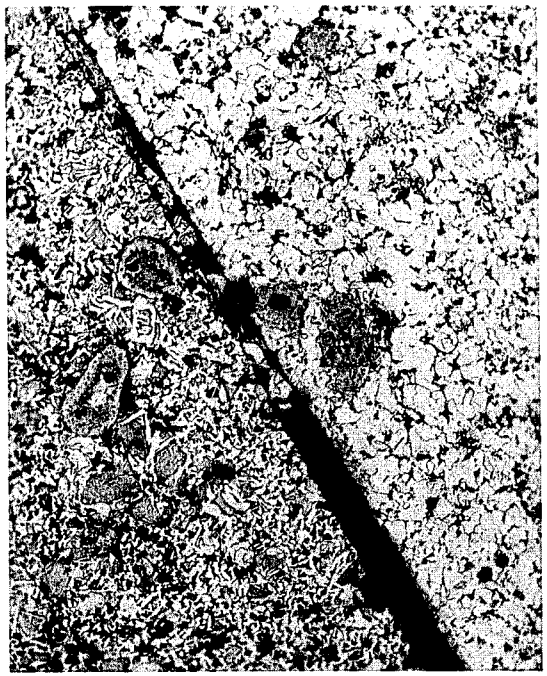
FIG. 4. PRIOR ART
FIG. 4 is a photomicrograph (100x) of a resulting sintered powder structure according to the prior art; the left side illustrates a product containing Fe, 0.5% Mn, 0.5% C (0.25% graphite added); the right side illustrates a product containing 0.5% Mn, 0.3% C and Fe.

The uniformity of the resulting product can best be illustrated by turning to FIGS. 4 and 5. FIG. 4 represents two compositions, one portion being shown on the left half and the other composition being shown on the right half. Uncoated pre-alloyed powder particles were mixed with base iron powder according to the above procedures and sintering step. The composition of the left hand portion contains 0.5% manganese and 0.5% carbon whereas the portion of the right hand contains 0.5% manganese and 0.3% carbon (the left hand sample had 0.25% graphite admixed. Turning to FIG. 5, the composition contained 2.0% manganese and 1.0% carbon. Note the uniformity and the lack of randomness of the manganese which occurs not only in the inner regions of the base iron powder particles but also in the surface film surrounding the base iron powder.

Figure 6:
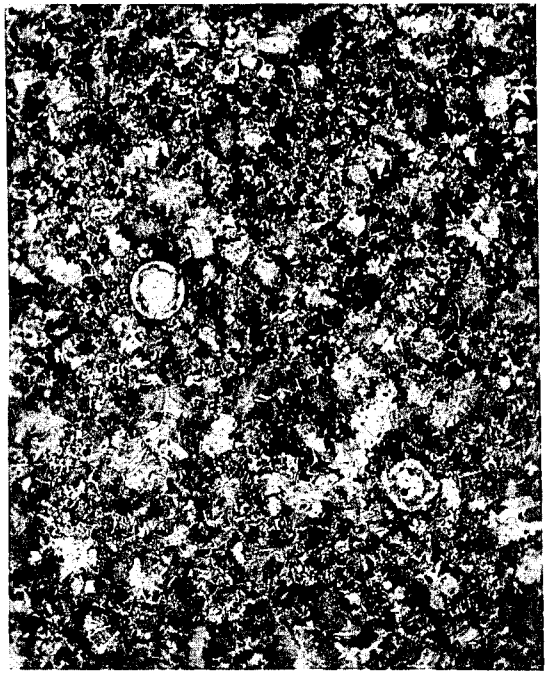
FIG. 6. PRIOR ART
FIG. 6 is a view like FIG. 4, of another prior art sintered product (the powders were uncoated) and contained Fe, 1% Cu, 1% Mn, and 0.5%.

In FIG. 6, a prior art composition is illustrated which contained 1% copper and 1% manganese added to the prealloyed powder with 0.5% carbon. Again the pre-alloyed powder was uncoated and did not contain any barrier against carbon diffusion during sintering fusion. In comparison, FIG. 7 shows a product which contained 1% manganese, 0.5% carbon and no copper in the pre-alloyed condition. Note the presence and distribution of manganese. Copper does not appear because it is soluble.

I claim as my invention:

1. A method for preventing solid state carbon diffusion in powder metallurgy techniques at elevated temperatures, comprising:

a. prepare at least a first hypoeutectic carbon iron based powder collection and a second hypereutectic carbon metal powder collection, each containing dissolved carbon with said first collection having a carbon content exceeding the carbon content of said second powder collection by at least 0.5% by weight, b. impart a thin envelope about substantially all particles of one of said powder collections, said envelope being comprised of a metal having a melting point lower than but substantially close to the melting point of said one powder collection, said metal being characterized by having a diffusivity for carbon therethrough in the solid state and being completely soluble in said one powder collection when the latter is in the molten state, said diffusivity being such that the carbon content of said second powder collection will not recede to below the eutectic point for said second collection during substantially the time involved in heating said second collection to the liquidus temperature, said envelope metal constituting from .1-1.5% by weight of said one powder collection, c. intimately and homogeneously mix said powder collection to form an admixture, and d. heat said admixture to provide an increase in temperature of the collections up to substantially the initial liquidus temperature for said first powder collection, said envelope preventing a carbon diffusion from one collection to the other during said temperature increase below the liquidus temperature, and hold said heated condition at about the liquidus temperature for said one powder collection to dissolve said envelope metal and to permit diffusion alloying and carbon exchange between said powder collections.

2. The method as in claim 1, in which said metal is selected from the group consisting of copper, silver, platinum and gold.

3. The method as in claim 1, in which each powder collection is comprised of iron-carbon matrix.

4. The method as in claim 1, in which said second powder collection is comprised of an iron base with carbon no greater than 2%, said first powder collection being comprised of an iron-carbon eutectic composition with alloying ingredients constituting between 5.0–20% thereof, and in which said first and second powders are mixed respectively in the ratio of 1/9 to 1/90.

5. A method making iron alloys, comprising:

a. providing a low carbon iron base powder and an iron alloy powder containing essentially a eutectic amount of carbon, b. thinly coat the surfaces of each particle of at least said alloy powder with a metal effective to act as a substantial barrier against carbon diffusion when said alloy powder is in the solid state, said barrier metal having a melting point lower than said iron alloy powder, c. intimately and homogeneously blend said base and coated alloy powders, d. compact said blended powders to a self-supporting green strength, and e. heat said compact to the liquidus temperature of said alloy powder and maintain said liquidus temperature for a period of time to permit carbon and alloy diffusion to take place between the powders to a stabilized value.

6. The method as in claim 5, in which said alloy and base powders are blended together respectively in a ratio no greater than 9/1.

7. The method as in claim 5, in which said alloy powder contains at least one of the elements Ni, Mo or Mn, the latter being present in an amount no greater than 20% by weight.

8. The method as in claim 5, in which the carbon of said alloy powder is 4.3–4.5%.

9. The method as in claim 5, in which said liquidus temperature is maintained for a period of time of about 20 minutes.

10. The method as in claim 5, in which said heated powders are air cooled under ambient conditions to achieve a hardened iron alloy.

11. A method of making powdered parts, comprising:

a. providing an iron-carbon-alloy powder in a particle size range of −100 +325 having a hypereutectic amount of carbon, b. coating said iron-carbon-alloy powder with copper by subjection to abrasive action of copper elements impacted with the particles of said iron-carbon-alloy powder, c. mixing said coated iron-carbon-alloy powder with a base iron powder having a hypoeutectic amount of carbon and having a lower carbon content than said iron-carbon-alloy powder, d. compacting said mechanically mixed powders under ambient temperature conditions and under a pressure of 30 tsi to a density of 6.6 g./cc. rendering a compact having a green strength of at least 1200 psi, e. subjecting said compact to liquid phase sintering under a protective atmosphere at a temperature in the range of 2060°–2100° F for a period of 20 minutes, f. allowing said sintered product to cool, and g. reheating said cooled sintered shape and hot working said shape at a temperature of about 1800° to a desired configuration and to a density of substantially 100%.

12. The method as in claim 11, in which the base powder is formed by water atomization having carbon content in the range of 0.03–0.35 and an oxygen content no greater than 0.5%, there being no graphite admixed with the powders.

13. The method as in claim 11, in which said ironcarbon-alloy powder is formed by atomization of a ferrous based melt having dissolved carbon and comprising at least 10% by weight of one or more elements selected from the group consisting of molybdenum, manganese, nickel, chromium and copper, said powder being sized about −200.

14. The product resulting from the practice of the method of claim 11, said product being characterized by a chemical analysis wherein the alloying ingredients constitute as a total 5–20%, and each individually no greater than 5–20%, the copper content of said resulting product being 0.01–1.5% and an increased strength in tension.

15. A method of making powder parts comprising:

a. preparing a hypereutectic carbon master alloy powder having the particles thereof provided with alloyed iron-carbon constituent, each particle having a thin protective coating of copper present in an amount no greater than 1.5% of the total master alloy powder, b. mechanically mixing said master alloy powder with a base iron powder having a carbon content less than 0.3% carbon, c. compacting said mechanical mixture to form a compact with a density of about d. sinter said compact in a protective atmosphere and at a temperature in the range of 2060°–2100° F, and said mechanical mixture having a liquidus in the range of 2066°–2100° F and a melting range less than 50° F.

16. The method as in claim 15 in which said sintered compact is further subjected to hot forming at a temperature no greater than 1800° F to provide a desired shape having a density substantially of 100%.

* * * * *